US005538140A

United States Patent [19]

Guenther et al.

[11] Patent Number: 5,538,140

[45] Date of Patent: Jul. 23, 1996

[54] BUFFERED STACKER WITH DROP FLOOR ASSEMBLY

[75] Inventors: Kenneth L. Guenther, Park Ridge; Tom Faber, Skokie; Joseph Kalika, Niles; Mel T. Kerstein, Lincolnwood; John S. O'Callaghan, Wilmette; K. George Rabindran, Morton Grove; Michael A. Wisniewski, Bolingbrook, all of Ill.

[73] Assignee: Bell & Howell Company, Skokie, Ill.

[21] Appl. No.: 326,122

[22] Filed: Oct. 19, 1994

[51] Int. Cl.[6] ..... B07C 5/00

[52] U.S. Cl. ..... 209/552; 209/583; 209/900; 271/298; 271/303; 271/189

[58] Field of Search ..... 271/297, 298, 271/299, 305, 303, 213, 220, 288, 189; 209/584, 583, 552, 900; 414/790.5, 790.9, 789.9

[56] References Cited

U.S. PATENT DOCUMENTS

| | | | |
|---|---|---|---|
| 2,765,167 | 10/1956 | Maher . | |
| 2,767,534 | 10/1956 | Nydegger et al. . | |
| 3,799,540 | 3/1974 | Buccicone . | |
| 3,901,797 | 8/1975 | Storace et al. . | |
| 4,162,733 | 7/1979 | Wiseman | 271/303 X |
| 4,493,484 | 1/1985 | Eyer | 271/303 X |
| 4,657,094 | 4/1987 | Mosher et al. . | |
| 5,186,336 | 2/1993 | Pippin et al. | 271/297 X |

*Primary Examiner*—David H. Bollinger
*Attorney, Agent, or Firm*—Welsh & Katz, Ltd.

[57] ABSTRACT

A buffered stacking system for selectively diverting horizontally disposed documents from a generally horizontal main conveying path, stacking the documents in a horizontal orientation and dropping the documents into replaceable receiving receptacles is provided. The system has a primary horizontal conveyor belt with a lower horizontal reach defining a horizontal primary conveying path. A plurality of sorting stations are located serially along and below the primary conveying path. Each of the sorting stations has at least one diverter arm disposed along the conveying path. The diverter arms are selectively movable from a generally horizontal position which allows passage of the documents along the conveying path to an inclined position to divert the document into the corresponding sorting station. The diverter arms divert the document in a downwardly inclined direction into a stacking station. The stacking station is formed with a lower drop floor assembly for supporting the diverted documents in a stacked generally inclined orientation and for pivoting open to allow the stacked documents to fall into a replaceable receiving bin located below a drop floor which forms a part of the drop floor assembly. The stacking assembly also includes a method of operation whereby the drop floor is activated when the documents in the stacking bin are equal to or higher than a predetermined height and when additional documents are not being diverted into the stacking bin.

9 Claims, 3 Drawing Sheets

BUFFERED STACKER WITH DROP FLOOR ASSEMBLY

BACKGROUND OF THE INVENTION

The present invention relates generally to an apparatus and system for sorting flat documents and more particularly to a system for horizontally transporting and sorting documents and having a novel stacking bin assembly with a mechanism for dropping the stacked documents into removable containers.

Sorting systems convey documents, such as mailing envelopes and the like, along a primary or main path from which the documents may be selectively diverted or sorted according to predetermined criteria such as a zip code as represented on a zip code label. Sorting systems typically transport the documents so that the documents are transported in a vertical on edge position by a primary conveyor belt. One or more document diverter or sorter stations are supported along the length of the primary conveyer belt. When supplied with a control signal from a controller or the like, the sorter station typically diverts the documents to a secondary path which is inclined to the primary conveyer path.

A significant drawback in an on edge document conveying systems is that when conveying relatively large flat documents their size and weight may cause the document to bend over which may interfere with the sorting mechanism. Also, the resistance to bending along the length of the document may interfere with the means for diverting the documents from the conveying path to a stacking station where the documents are collected.

Another drawback found in the on edge sorting system is the receiving containers such as mail bins are configured to contain documents which are stacked in a horizontal relationship. Thus, the document being transported on edge down a conveyer path must be diverted to a secondary path where the document is reoriented to the horizontal direction before being placed in the stacking bin. This reorientation adds to the complexity of the sorting apparatus.

An additional drawback is found in continuous sorting systems which sort documents into receiving bins capable of holding only a finite number of documents. When the receiving bins become full, the full bin must be replaced with a bin capable of receiving diverted documents. However, additional documents may be diverted while the full bin is being replaced.

A further drawback found in on edge sorting systems is that by diverting the documents to one side of the transporting path and placing the documents into receiving bins at the sides of the transporting path, the footprint of the diverter station is widened. In many facilities having multiple sorting systems this widening of the footprint may lead to crowding.

It is therefore an object of the present invention to provide an improved sorting assembly for documents. A related object is to provide an improved sorting assembly for documents which includes an apparatus for transporting the sorted documents to receiving containers.

Another object of the present invention is to provide an improved sorting assembly particularly adapted to the sorting of large or bulky documents.

A further object of the present invention is to provide an improved sorting assembly which places sorted documents in a horizontal orientation in receiving containers. A related object is to place the documents in the horizontal orientation while minimizing any reorientation of the document after the document has been sorted.

A still further object of the present invention is to provide an improved sorting apparatus which allows receiving containers to be replaced without disrupting the sorting operation.

SUMMARY OF THE INVENTION

Accordingly a buffered stacking system for selectively diverting horizontally disposed documents from a generally horizontal main conveying path, stacking the documents in a horizontal orientation and dropping the documents into replaceable receiving receptacles is provided. The system has a primary horizontal conveyor belt with a lower horizontal reach defining a horizontal primary conveying path. A plurality of sorting stations are located serially along and below the primary conveying path.

Each of the sorting stations has at least one diverter arm disposed along the conveying path. The diverter arms are selectively movable from a generally horizontal position which allows passage of the documents along the conveying path to an inclined position to divert the document into the corresponding sorting station. The diverter arms divert the document in a downwardly inclined direction into a stacking station. The stacking station is formed with a lower drop floor assembly for supporting the diverted documents in a stacked generally inclined orientation and for pivoting open to allow the stacked documents to fall into a replaceable receiving bin located below a drop floor forming a part of the drop floor assembly.

The stacking assembly also includes a method of operation whereby the drop floor is activated when the documents in the stacking bin are equal to or higher than a predetermined height and when additional documents are not being diverted into the stacking bin.

DESCRIPTION OF THE PREFERRED EMBODIMENT

Figure 1:
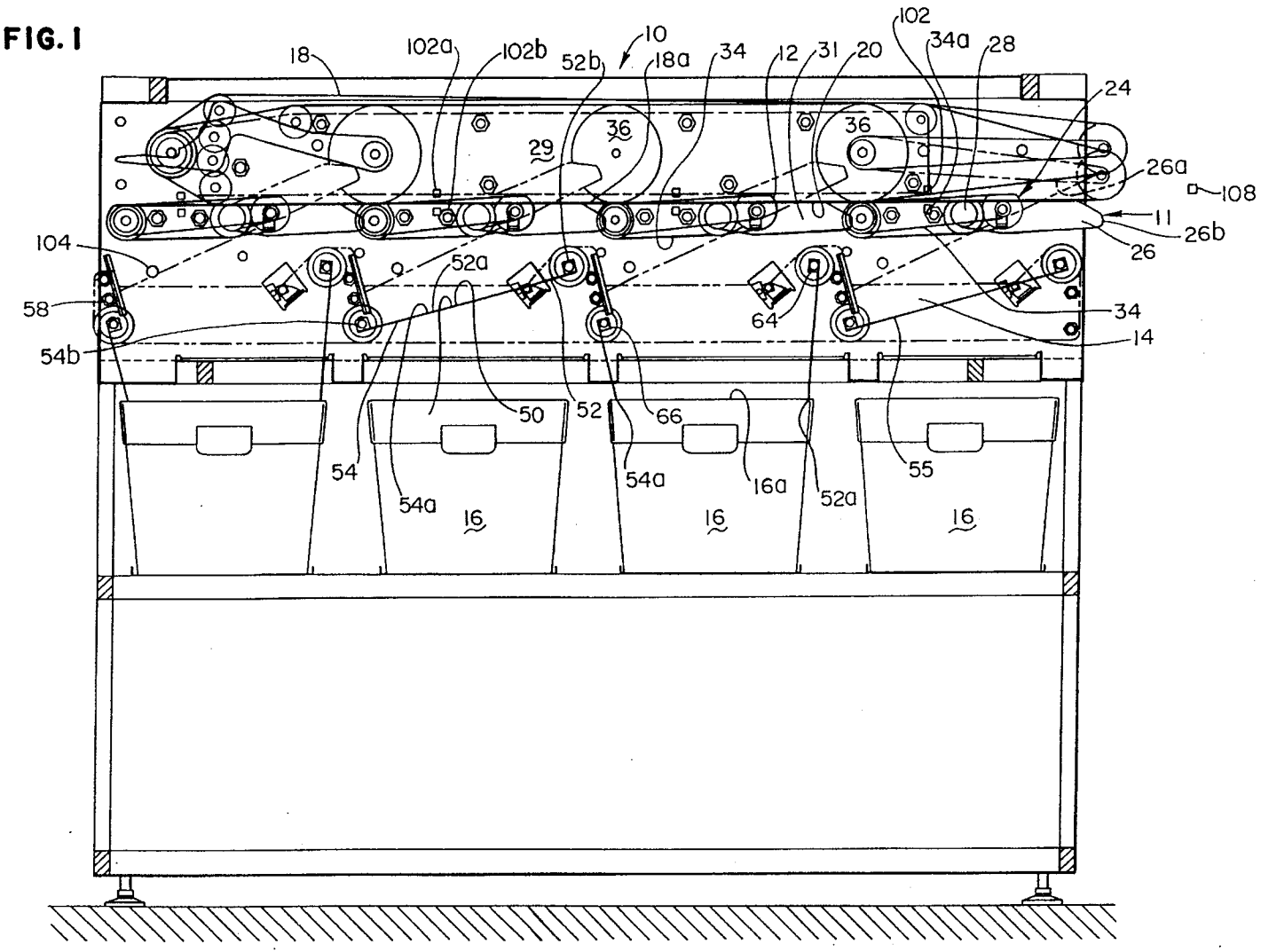
FIG. 1 is a front side elevational view of a buffered stacker constructed in accordance with the invention.
Figure 2:
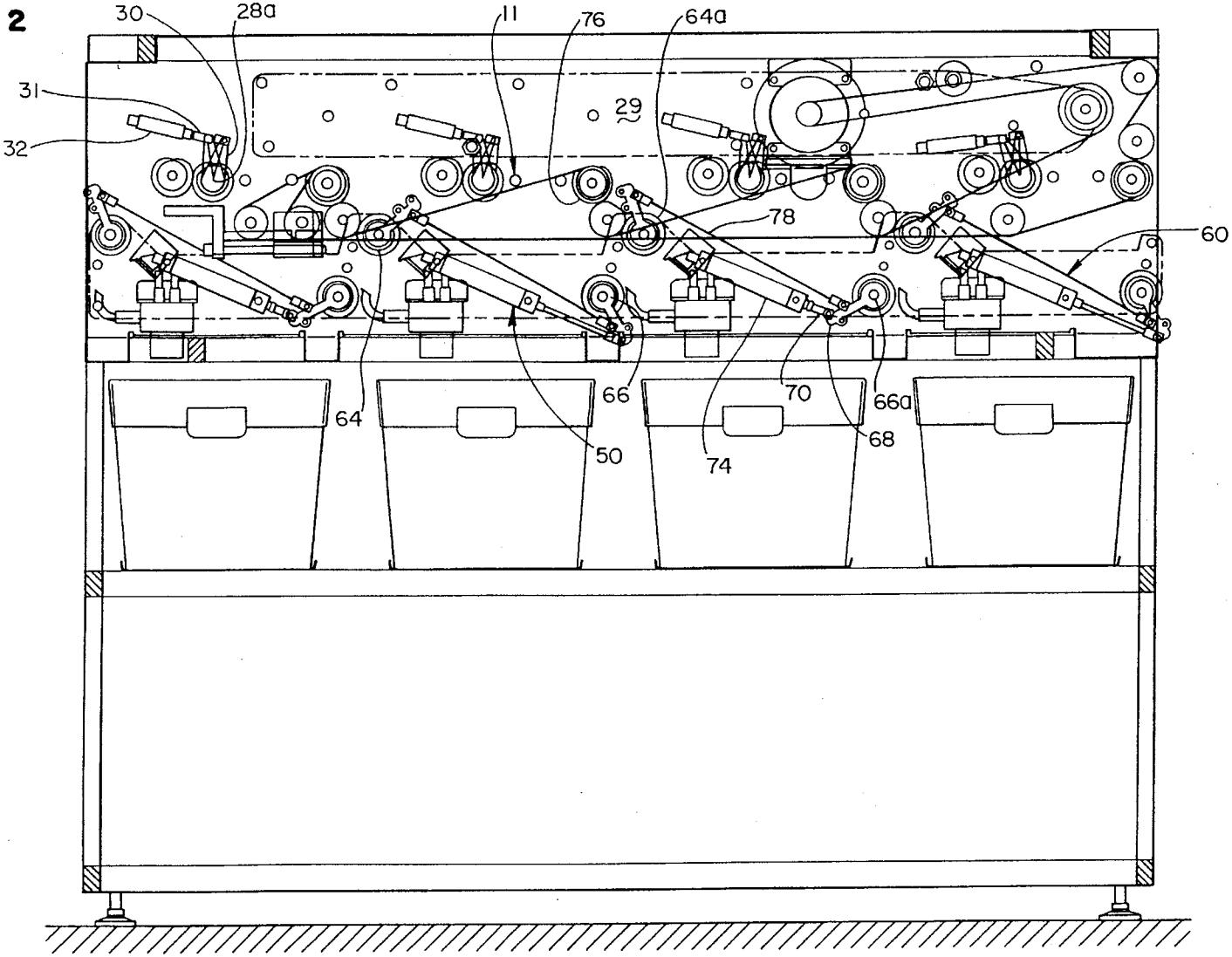
FIG. 2 is a back side elevational view of the buffered stacker of FIG. 1.

Referring to FIGS. 1 and 2, a diverting and buffered drop floor stacking system constructed in accordance with the present invention is indicated generally at 10. The system 10 may form a portion of a larger high speed system for processing large flat documents, such as envelopes, catalogs and the like. Upstream of the stacking system 10, the documents are typically singulated and a sorting destination is assigned to each document. The sorting destination may be assigned automatically with an optical code reader or by other methods such as manual key entry or the like.

The documents are transported to the stacking system 10 in a horizontal one at a time relationship along a primary conveying path from the upstream stations. The illustrated diverter and stacking system includes a plurality of sorting stations 11. Each of the sorting stations 11 includes a diverter assembly, such as indicated at 12, to divert the conveyed document from the primary conveying path to a stacking station 14 also forming a part of the sorting station 11. The stacking station 14 stacks and aligns the diverted documents.

The stacked documents are then dropped into a replaceable receiving bin 16 for subsequent handling.

The stacking system 10 includes an upper endless primary conveying belt, indicated generally at 18, having a lower reach 18*a* which defines the main conveying path 20. The sorting stations 11 are disposed serially along the conveying path 20.

Each of the diverter stations 12 includes a diverter arm assembly 24 for selectively diverting documents, being transported down the path 20, into the stacking station 14. The diverter arm assembly 24 includes a wedged shaped flipper 26 which is attached to the forward end of a generally horizontal shaft 28 disposed generally adjacent the conveying path 20. The shaft 28 is rotatably journaled in a vertical portion of a support frame 29. Referring in particular to FIG. 2, an actuating lever 30 is attached to the rear end of the shaft 28. A rod end 31 of a pneumatic actuating cylinder 32 is operably attached to the actuating lever 30. Operation of the cylinder 32 pivots the lever 30 to reciprocally rotate the shaft 28. The rotation of the shaft 28 pivots the flipper 26 between an upwardly angled diverting position 26*a*, as shown in shadow in FIG. 1, and the horizontal position. In the horizontal position, an upper edge of the flipper 26 defines a portion of the horizontal conveying path 20. In the diverting position, the flipper 26 diverts the document being conveyed along the path 20 to the sorting station 11 through a passageway 31 formed between adjacent lower endless belts 34 and into the stacking station 14. The longitudinal length of the passageway 31 along the conveying path 20 allows the documents to be downwardly tilted by the flipper 26 while minimizing the bending of the document which facilitates the diversion of large or bulky documents.

Along the lower side of the conveying path 20, are the lower endless belt assemblies 34 having upper reaches 34*a* which lie along the conveying path 20 and in juxtaposed contacting relation with the lower reach 18*a* of the upper belt 18. Preferably, the upper belt 18 and lower belts 34 are driven so that the upper reaches 34*a* of the lower belts and the lower reach 18*a* of the upper belt travel downstream at the same linear speed along the conveying path 20.

Adjacent lower belt assemblies 34 are separated by one of the diverter assemblies 24. The diverter assemblies 24 are arranged so that when the flipper 26 is in the horizontal position, an upstream tip 26*b* of the flipper is downstream and in close proximity to the immediately upstream lower belt 34 to prevent jamming of the document between the flipper and lower belt assembly 34. To provide more positive control of documents transported down the path 30, a series of buffer rollers 36 may be disposed above and adjacent the lower reach 18*a* of the upper belt 18 so as to provide a pinch force between the lower reach 18*a* and the upper reach 34*a* of lower belt 34.

The stacking station 14 includes a drop floor assembly, indicated generally at 50 to selectively support the diverted documents. The drop floor assembly 50 includes an upstream planar floor section 52 and downstream planar floor section 54. When the floor sections 52, 54 are in a document supporting position, the upstream floor section is aligned with the downstream floor section 54 and an inner transverse edge 52*a* of the upstream floor section 52 is coparallel to and in close proximity to an inner transverse edge 54*a* of the downstream floor section 54 to form a gap 55 between the edges. The inner upstream edge 52*a* and the inner downstream edge 54*a* may be directly opposing each other. The inner upstream edge 52*a* may also be slightly higher than the inner downstream edge 54*a* so that the upstream edge 52*a* shields the gap 55 to prevent diverted documents from catching on the downstream edge 54*a* and jamming into the gap 55.

Also, in the document supporting position, the upstream floor section 52 and downstream floor section 54 define a drop floor 56 which is angled downward in the downstream direction. Documents which are diverted into the stacking station 14 contact the drop floor 56 and typically slide down the drop floor until a downstream edge of the document strikes an alignment plate 58 which aligns the downstream or leading edge of the documents stacked on the drop floor. The alignment plate 58 preferably extends upward from a point adjacent the downstream edge 54*b* of the downstream floor section 54 and in a direction generally normal to the alignment of the drop floor 56 in the document supporting position.

Referring to FIGS. 1 and 2, the floor assembly 50 also includes a pivoting mechanism 60 for pivoting the upstream floor section 52 and downstream floor section 54 from the document supporting position to a generally vertical orientation whereby the documents drop into the receiving receptacle 16 located below the drop floor 56. The pivoting mechanism 60 includes an upstream shaft 64 which is fixedly attached to the upstream edge 52*b* of the upstream floor section 52, and a downstream shaft 66 which is fixedly attached to the downstream edge 54*b* of the downstream floor section 54. Each of the shafts 64, 66 extends through and is rotatably mounted to the vertical support 29. The upstream shaft 64 is positioned higher than the downstream shaft 66 so that the drop floor 56 is downwardly inclined in the downstream direction.

Referring to FIG. 2, a rear end 66*a* of the downstream shaft 66 is attached to a first actuating lever 68. The actuating lever 68 is operably attached to a rod end 70 of an actuating cylinder 74 which is in turn attached to the vertical support 29. Extension of the rod end 70 pivots the first actuating lever 68 thereby rotating the downstream shaft 66 and pivoting the downstream floor section 54. The cylinder 74 and first actuating lever 68 are oriented so that the pivoting of the lever causes the downstream floor section 54 to pivot between the document stacking position and the vertical drop position.

A rear end 64*a* of the upstream shaft 64 is attached to a second actuating lever 76. The first actuating lever 68 and second actuating lever 76 are interconnected so that pivoting of the first actuating lever causes a similar pivoting of the second actuating lever to operably pivot the upstream floor section 52 between the document stacking position and the vertical drop position. The first and second actuating levers 68, 76 are preferably interconnected by a rigid rod 78 having ends attached to the first and second actuating levers. Other linkages, mechanical, electrical or otherwise, are also contemplated.

The upstream floor section 52 preferably has a longitudinal length which is greater than the longitudinal length of the downstream floor section 54. Thus, when the upstream and downstream floor sections 52, 54 are pivoted into the vertical orientation, the inner edges 52*a* and 54*a*, respectively, are horizontally aligned. In addition, the distance between the receiving receptacle 16 and the drop floor 56 is sized so that when the upstream and downstream floor sections 52, 54 are pivoted into the vertical orientation, the inner edges 52*a* and 54*a*, respectively, extend downward just within the receiving receptacle. Having the edges 52*a*, 54*a* just within the receptacle 16 reduces the possibility that the stack of documents previously placed into the receiving receptacle may interfere with the pivoting of the drop floor 56.

Figure 3:
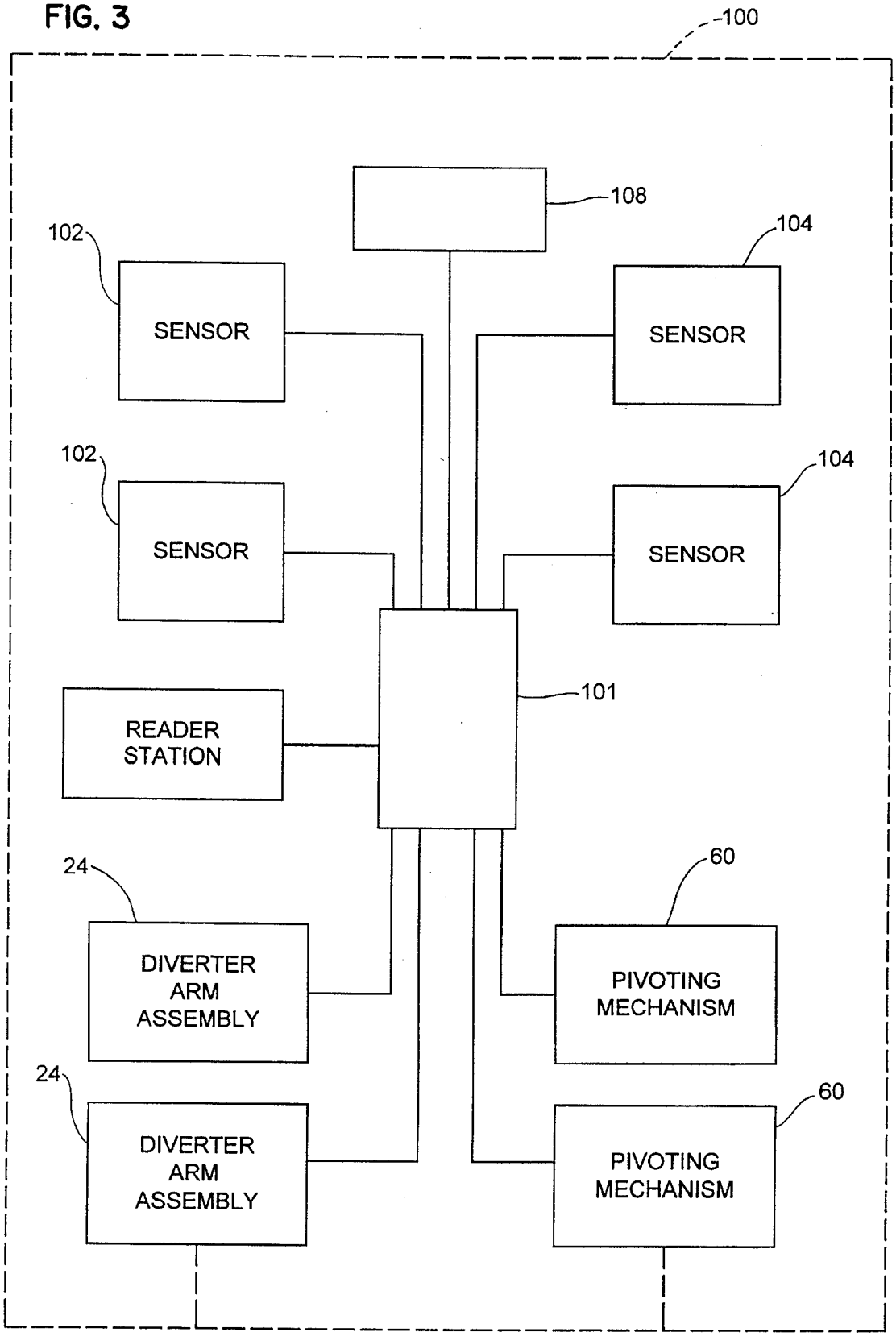
FIG. 3 is a diagrammatic view of a control system forming a part of the buffered stacker of FIG. 1.

Referring to FIGS. 3 in conjunction with FIG. 1, the actuation of the diverter arm assembly 24 and drop floor assembly 50 for each of the diverting stations 12 and corresponding stacking stations 14, is operably controlled by a control system 100. The control device 100 includes a controller 101. Providing inputs to the controller 101 are a diverter arm sensor 102 forming a part of each of the diverter stations 12 and a stacking station sensor 104 forming a part of the stacking station 14. Output signals from the controller 101 may be provided to selectively actuate the diverter stations 18 and the pivoting mechanism 60 of the drop floor assemblies 50.

The diverter sensors 102 are operative to sense the leading edge of documents as the documents are conveyed down the conveying path 20. Preferably each of the diverter stations 12 includes a diverter sensor 102 with the diverter sensor located upstream from the corresponding diverter station. The distance upstream should be sufficient so that the control system 100 will have sufficient time to activate the diverter arm assembly 24 when the leading edge of a document to be diverted is sensed. Each of the diverter sensors 102 includes a light emitting element 102*a* and a light sensing element 102*b* disposed on opposite sides of the conveying path 20 although other sensor devices are contemplated.

Each of the stacking stations 14 includes one of the stacking station sensor 104 which determines when the height of the documents stacked upon the drop floor 56 reaches a predetermined height. The sensor 104 is mounted on the support frame 29 at a distance above the drop floor 56 which corresponds to the desired height of the stack of collected documents before the drop floor assembly 50 is operated.

Referring to FIGS. 1 and 3, in operation, the documents are conveyed horizontally down the primary conveying path 20 and a destination sorting station 11 is assigned to each document. The destination sorting station information is then provided to the controller 102 of the control system 100. The document is then transported to the buffer stacker 10 and fed into the horizontal primary conveying path 20 formed between the upper primary conveying belt 18 and the series of alternating secondary conveying belts 34 and diverter stations 12.

The control system 100 may include a sensor 108 disposed at the beginning of the conveying path 20 to determine when the leading edge of the document passes the sensor to sense when the document enters the sorting system 10. The control system 100 may then monitor the position of the document as the document is conveyed along the path 20 through the sensing of the leading edge of the document by the diverter sensors 102 distributed along the conveying path.

Referring also to FIG. 2, when the leading edge of the document is sensed by the diverter sensor 102 corresponding to the diverter station 12 at which the document is to be diverted, the controller 102 sends an output signal to actuate the actuation cylinder 32 of the diverter arm assembly 24. The actuation cylinder 32 pivots the flipper 26 into the diverting position.

The flipper 26 diverts the horizontally conveyed document through the passageway 31 between the flipper and the secondary belt 34 of the immediately upstream sorting station 11 and into the stacking station 14. The document then contacts either the drop floor 56 or documents stacked on the drop floor. The generally downstream directional velocity of the document and the downwardly angled inclination of the drop floor 56 cause the document to slide along the drop floor or stacked documents until the leading edge strikes the alignment plate 58. The alignment plate 58 generally aligning the leading edge of the documents stacked on the drop floor.

When the stack of documents reaches the stacking station sensor 104, the sensor sends an output signal to the controller 101. Once having received a signal from the stacking station sensor 104, the controller 101 determines the appropriate time for activating the drop floor assembly 50 of that stacking station 14. The appropriate time is preferably when no additional documents enter the stacking station 14 during the dropping process to reduce the possibility of documents getting caught in the dropping floor assembly 50 during the dropping process.

The controller 101 preferably activates the drop floor assembly 50 when the output from the reader station indicates that of the documents being transported along the primary conveying path 20, one or more of the documents is not to be diverted into that stacking station 14, thereby creating a gap in the transported documents. Should a predetermined number of additional documents, as counted by the controller 101, be diverted into the stacking station after the stacking station sensor 104 is activated and without a gap occurring, the controller 101 creates a gap by not diverting a document which normally is to be diverted into the stacking station 14.

Once the gap occurs or is created, the controller 101 actuates the pivoting mechanism 60. The pivoting mechanism 60 pivots the upstream floor 52 and the downstream floor 54 from the document supporting position to the vertical drop position. The stacked documents drop downward into the receiving receptacle 16, and the upstream floor 52 and the downstream floor 54 are pivoted back into the document supporting position by the pivoting mechanism 60.

The documents maintain their horizontal alignment and their alignment relative to each other by the vacuum effect induced between adjacent documents as the documents drop. This vacuum effect is particularly beneficial when the upper documents are flimsy or light.

Because the receiving receptacles 16 are located directly below the stacking station 14, the width of the footprint of the buffered stacker 10 is reduced. In addition, a full receiving receptacle 16 may be replaced with an empty receptacle without stopping the sorting operation.

A specific embodiment of the novel buffered stacker with drop floor assembly according to the present invention has been described for the purposes of illustrating the manner in which the invention may be made and used. It should be understood that implementation of other variations and modifications of the invention in its various aspects will be apparent to those skilled in the art, and that the invention is not limited by the specific embodiment described. It is therefore contemplated to cover by the present invention any and all modifications, variations, or equivalents that fall within the true spirit and scope of the basic underlying principles disclosed and claimed herein.

What is claimed is:

1. A system for selectively diverting horizontally disposed documents being conveyed along a main conveying path, then stacking and placing the documents into replaceable receiving receptacles, the system comprising:

a primary conveyor belt having a lower reach defining the main conveying path;

a plurality of sorting stations disposed below and along the main conveying path, the sorting stations including;

means for downwardly diverting the document from the main conveying path, means for stacking the diverted documents and downwardly dropping the stacked documents into the replaceable bins; and control means operably attached to said sorting stations for selectively sorting the document into one of said sorting stations in dependence on a specified sorting criteria.

2. The system of claim 1 wherein the stacking means includes a drop floor to facilitate dropping the stacked documents into the replaceable bins, said drop floor being generally downwardly inclined in the downstream direction, said drop floor being generally planar and configured to be reciprocally displaced between a document supporting position and a document dropping position, said drop floor supporting the stacked documents when disposed in the document supporting position.

3. The system of claim 2 wherein the sorting station includes alignment means generally adjacent a downstream edge of said drop floor for aligning the downstream edges of the documents supported on said drop floor when said drop floor is disposed in the document supporting position.

4. The system of claim 2 wherein said drop floor includes an upstream floor section and a downstream floor section, said stacking means including means for pivoting said upstream and said downstream floor sections of the drop floor between said document supporting position and said document dropping position, said document dropping position being generally vertically oriented.

5. The system of claim 4 wherein said upstream floor section and said downstream floor section form inner edges which oppose each other when said upstream floor section and said downstream floor section are in said document supporting position, said upstream floor section and said downstream floor section being sized so that said inner edges are horizontally aligned with each other when said upstream floor section and said downstream floor section are in the document dropping position.

6. The system of claim 1 wherein said diverting means is separated from a diverting means of an adjacent sorting station by a secondary belt having an upper reach in juxtaposed contacting relationship with said lower reach of said primary conveying belt.

7. A system for selectively diverting horizontally disposed documents being serially conveyed along a main conveying path, then stacking and placing the documents into replaceable receiving receptacles, the system comprising:

a primary conveyor belt having a lower reach defining the main conveying path;

a plurality of sorting stations disposed below and along the main conveying path, the sorting stations including;

means for downwardly diverting the documents from the main conveying path, means for stacking the diverted documents, means for downwardly dropping the stacked documents into the replaceable bins, said dropping means configured to be reciprocally displaced between a document supporting position and a document dropping position; and activating means operatively coupled to the dropping means, said activating means controlling the dropping means directing the dropping means to be disposed in the document dropping position when the stacked documents reach a predetermined height and when no additional documents are being diverted by said diverting means into said stacking means.

8. The system of claim 7 wherein said activating means includes control means for determining when a conveyed document is not to be diverted into said sorting station having the stack of documents at said predetermined height at which time said activating means drops said stacked documents.

9. The system of claim 8 wherein said control means prevents the diversion of a document by said diverting means when the stack of documents reaches said predetermined height and a predetermined number of additional documents are diverted into said stacking means.

* * * * *